US012790848B2

(12) United States Patent
Wang et al.

(10) Patent No.: US 12,790,848 B2
(45) Date of Patent: Nov. 10, 2026

(54) ROBOT SWIMMING POOL CLEANER

(71) Applicant: Shenzhen Aiper Intelligent Co., Ltd., Shenzhen (CN)

(72) Inventors: Yang Wang, Shenzhen (CN); Xueliang Yu, Shenzhen (CN); Yangchun Luo, Shenzhen (CN)

(73) Assignee: Shenzhen Aiper Intelligent Co., Ltd., Shenzhen (CN)

( * ) Notice: Subject to any disclaimer, the term of this patent is extended or adjusted under 35 U.S.C. 154(b) by 354 days.

(21) Appl. No.: 18/308,136

(22) Filed: Apr. 27, 2023

(65) Prior Publication Data

US 2024/0076890 A1 Mar. 7, 2024

(30) Foreign Application Priority Data

Sep. 6, 2022 (CN) ..... 202222465553.7

(51) Int. Cl.
*E04H 4/16* (2006.01)
*A47L 11/40* (2006.01)

(52) U.S. Cl.
CPC ..... *E04H 4/1654* (2013.01); *A47L 11/4063* (2013.01); *A47L 2201/00* (2013.01)

(58) Field of Classification Search
CPC ..... E04H 4/16; E04H 4/1654; A47L 11/4063; A47L 11/4066; A47L 2201/00; A47L 11/4069
USPC ..... 15/1.7
See application file for complete search history.

(56) References Cited

U.S. PATENT DOCUMENTS 11,649,651 B1 * 5/2023 Tang ..... B62D 55/12 15/387
11,802,417 B2 * 10/2023 Tang ..... B62D 57/024
2011/0020139 A1 * 1/2011 Pichon ..... E04H 4/1654 417/46

FOREIGN PATENT DOCUMENTS

CN 110670918 A * 1/2020 ..... E04H 4/1654
CN 112942918 A * 6/2021 ..... E04H 4/1654

* cited by examiner

*Primary Examiner* — Laura C Guidotti
(74) *Attorney, Agent, or Firm* — Westbridge IP LLC

(57) ABSTRACT

Disclosed is a robot swimming pool cleaner, including a main body and a first driving wheel rotatably disposed on the main body; the main body is therein provided with a sealed compartment and a garbage bin; the sealed compartment is therein provided with a motor; an output shaft of the motor is provided with a first output gear; the first output gear is located out of the sealed compartment; and an inner side of the first driving wheel is provided with a first inner gear meshed with the first output gear. The first inner gear is provided on the inner side of the first driving wheel, the first output gear is provided on the output shaft of the motor, consequently, thereby improving the loading capacity of the garbage bin.

12 Claims, 4 Drawing Sheets

ROBOT SWIMMING POOL CLEANER

CROSS-REFERENCE TO RELATED APPLICATIONS

The present application claims priority to Chinese Patent Application No. 202222465553.7, filed on Sep. 6, 2022, the content of which is incorporated herein by reference in its entirety.

TECHNICAL FIELD

The application relates to the technical field of swimming pool cleaning, and in particular to a robot swimming pool cleaner.

BACKGROUND

With the development of automation, a robot is widely applied to our life. A robot swimming pool cleaner is a robot cleaner invented for cleaning the swimming pool. The swimming pool always has garbage, such as dust, human body exfoliative objects, tree leaves, insect corpse, etc. The robot swimming pool cleaner may collect the garbage so as to clean the swimming pool, however, the robot swimming pool cleaner is limited in size and influenced by a layout of different parts; an engine compartment and a battery compartment may occupy most of the space, resulting in insufficient garbage loading capacity, frequent cleaning of the garbage bin, inconvenience for use and poor user experience.

SUMMARY

A technical problem to be solved by the present application is to provide a robot swimming pool cleaner with a higher space utilization rate.

In order to solve the above technical problem, the present application adopts the following technical solution: the robot swimming pool cleaner includes a main body and a first driving wheel rotatably disposed on the main body, the main body is therein provided with a sealed compartment and a garbage bin, the sealed compartment is therein provided with a motor, an output shaft of the motor is provided with a first output gear, the first output gear is located out of the sealed compartment, and an inner side of the first driving wheel is provided with a first inner gear in meshed connection with the first output gear.

Further, the robot swimming pool cleaner further includes a second driving wheel rotatably disposed on the main body, the first driving wheel is disposed close to a front end of the main body, and the second driving wheel is disposed close to a rear end of the main body.

Further, the first driving wheel is further provided with a first outer gear, a side wall of the main body is further provided with a gear component, and the first outer gear is in meshed connection with the gear component. The robot swimming pool cleaner further includes a rolling brush connected with the gear component.

Further, a wheel hub of the first inner gear, the first outer gear and the first driving wheel are integrally formed by injection molding.

Further, the gear component includes a first transmission gear and a second transmission gear which are in meshed connection, the first outer gear is meshed with the first transmission gear, and the rolling brush is connected to the second transmission gear.

Further, the first outer gear, the first transmission gear and the second transmission gear are distributed triangularly, and connecting lines for central rotating axes of the first outer gear, the first transmission gear and the second transmission gear on the same plane form a triangle.

Further, the side wall of the main body is provided with a third transmission gear, a fourth transmission gear and a fifth transmission gear; the output shaft of the motor is further provided with a second output gear; an inner side of the second driving wheel is provided with a second inner gear; the second output gear is in meshed connection with the third transmission gear; the third transmission gear is in meshed connection with the fourth transmission gear; the fourth transmission gear and the fifth transmission gear are connected to an identical rotating shaft; and the fifth transmission gear is in meshed connection with the second inner gear.

Further, the first output gear and the fifth transmission gear are symmetrically disposed relative to a vertical plane where a central axis of the third transmission gear is located.

Further, the second output gear and the fourth transmission gear are symmetrically disposed relative to the vertical plane where the central axis of the third transmission gear is located.

Further, a side surface of the main body is provided with a protection plate, the protection plate and the main body are connected to form an enclosed space, and the second output gear, the third transmission gear and the fourth transmission gear are disposed in the enclosed space.

The present application has the following beneficial effects: the main body is therein provided with the sealed compartment and the garbage bin, the sealed compartment is therein provided with the motor, the output shaft of the motor is provided with the first output gear; the first inner gear is provided on the inner side of the first driving wheel, thus the whole sealed compartment provided with the motor may be close to one end of the main body, and a larger space is reserved on the other side of the main body for the garbage bin, thereby improving the loading capacity of the garbage bin.

DETAILED DESCRIPTION OF THE EMBODIMENTS

In order to illustrate technical contents, achieved purposes and effects of the present application in detail, the technical contents, the achieved purposes and the effects are described below in combination with implementation modes and drawings.

Figure 1:
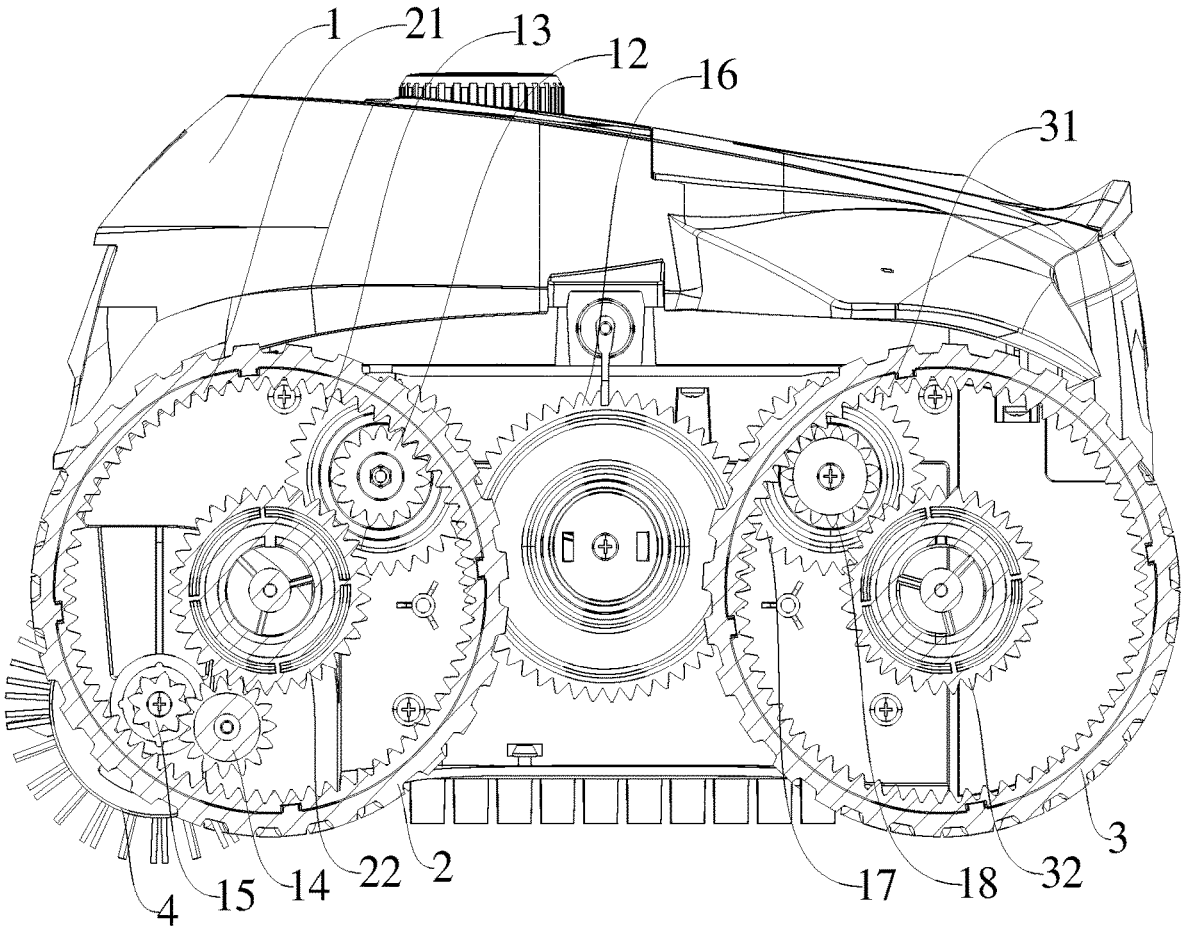
FIG. 1 illustrates a structural schematic diagram of a robot swimming pool cleaner in embodiment I of the present application.
Figure 2:
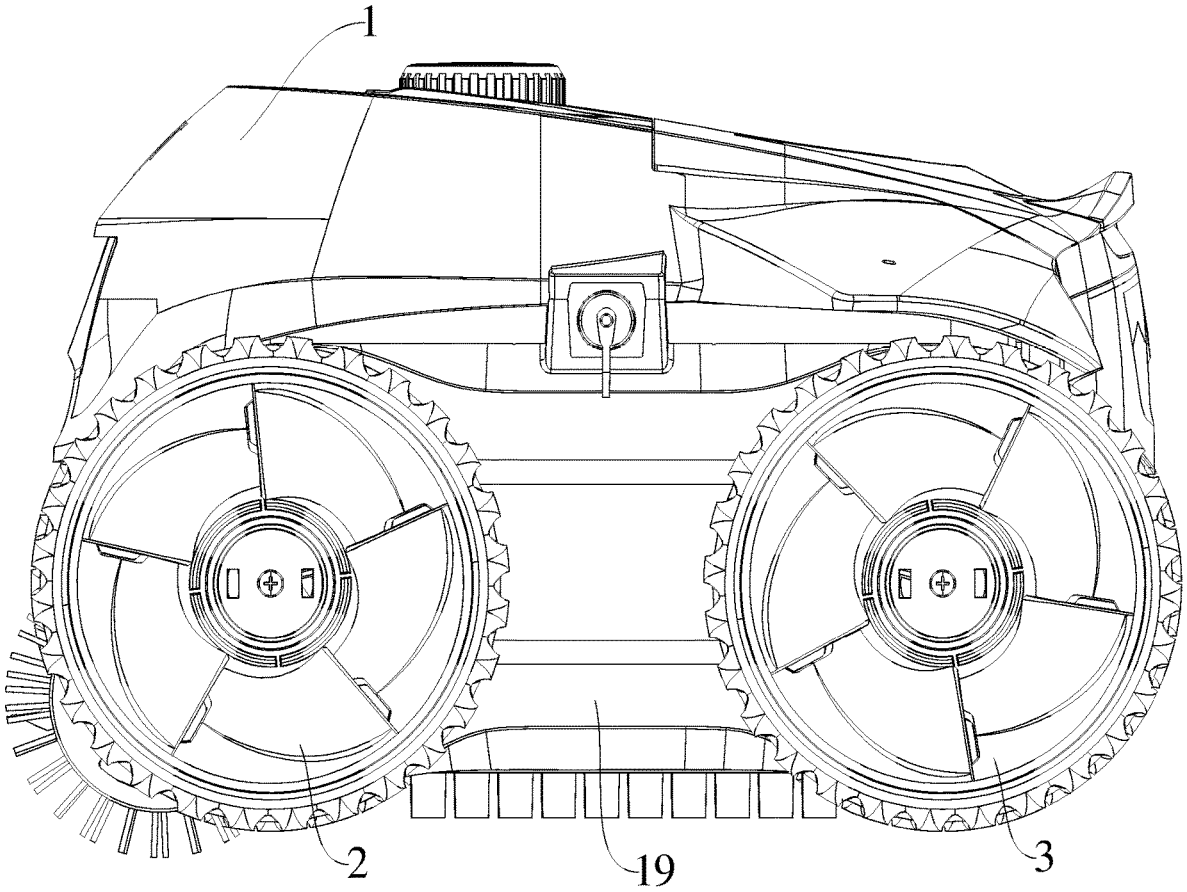
FIG. 2 illustrates a side view of a robot swimming pool cleaner in embodiment I of the present application.
Figure 3:
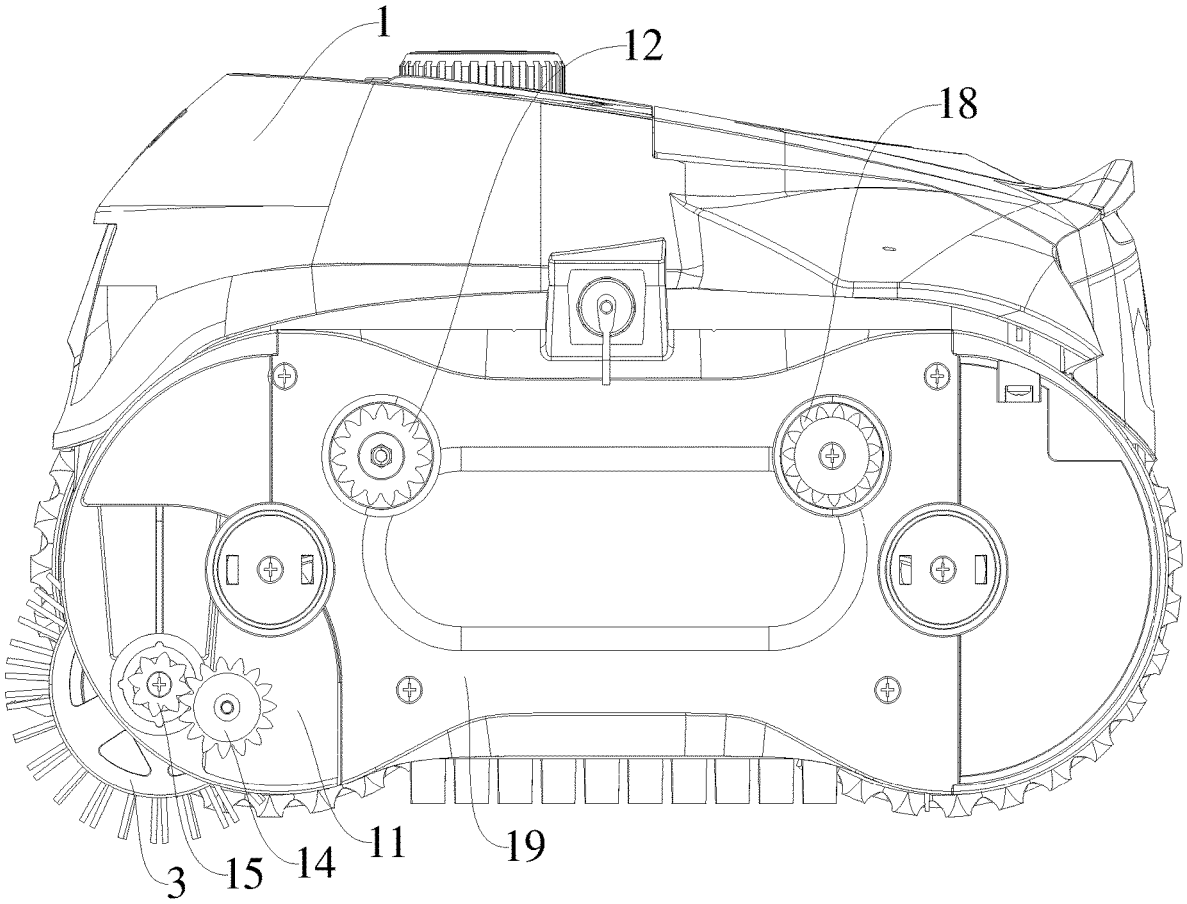
FIG. 3 illustrates a structural schematic diagram of a protection plate in embodiment I of the present application.
Figure 4:
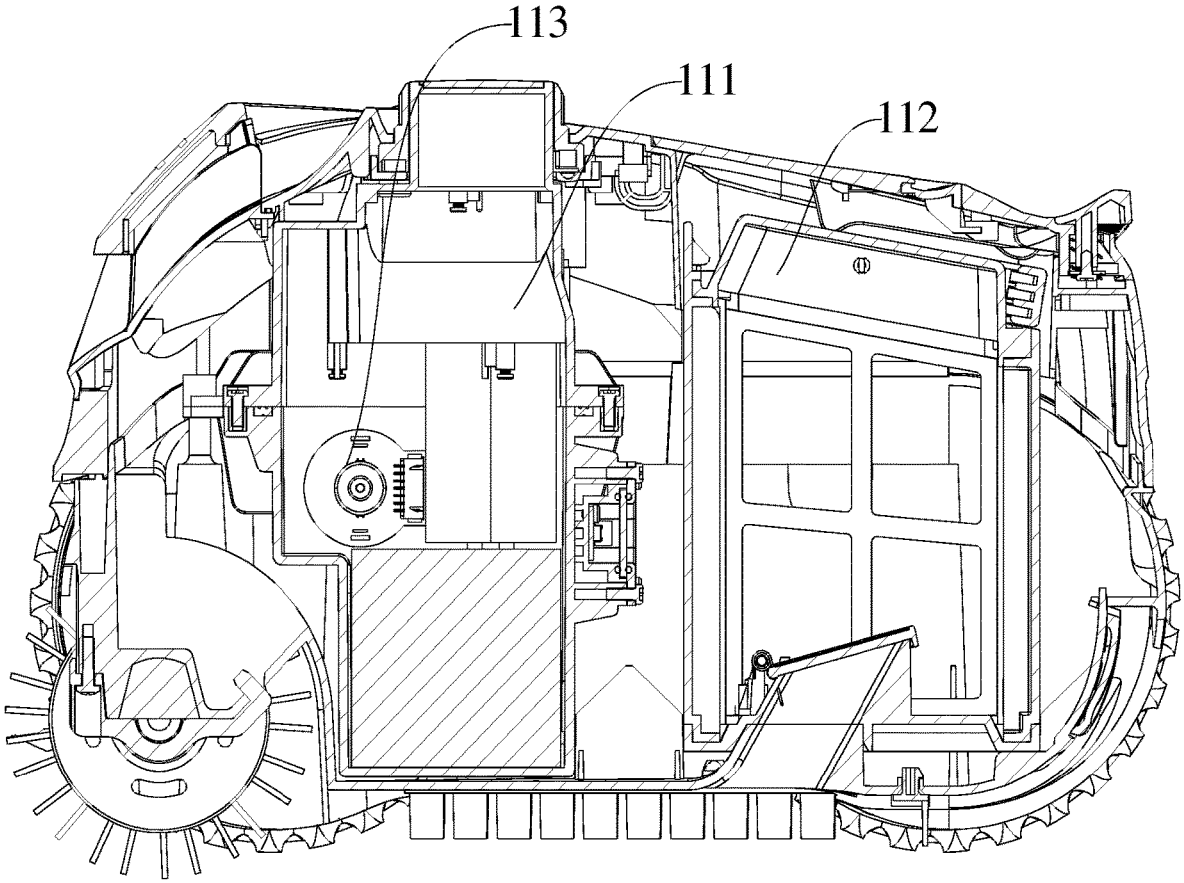
FIG. 4 illustrates a sectional view of a robot swimming pool cleaner in embodiment I of the present application.

Referring to FIG. 1-3, a robot swimming pool cleaner includes a main body 1 and a first driving wheel 2 rotatably disposed on the main body 1, the main body 1 is therein provided with a sealed compartment 111 and a garbage bin, the sealed compartment 111 is therein provided with a motor 113, an output shaft of the motor 113 is provided with a first output gear 12, the first output gear 12 is located out of the sealed compartment 111, and an inner side of the first driving wheel 2 is provided with a first inner gear 21 in meshed connection with the first output gear 12.

An operating principle of the present application is briefly described below: when the robot swimming pool cleaner works, the output shaft of the motor 113 drives the first output gear 12, the first output gear 12 drives the first inner gear 21, and the first inner gear 21 drives the first driving wheel 2 to enable the robot swimming pool cleaner to move.

It may be known from the above description that the present application has the following beneficial effects: the first inner gear 21 is provided on the inner side of the first driving wheel 2, the first output gear 12 is provided on the output shaft of the motor 113, the whole sealed compartment 111 provided with the motor 113 may be disposed close to one end of the main body, and a larger space is reserved on the other side of the main body 1 for the garbage bin, thereby improving the loading capacity of the garbage bin.

Further, the robot swimming pool cleaner further includes a second driving wheel 3 rotatably disposed on the main body, the first driving wheel 2 and the second driving wheel 3 are respectively disposed close to two ends of the main body 1.

It may be known from the above description that the motor 113 is meshed with the first inner gear 21 through the first output gear 12 to drive the first driving wheel 2 to rotate.

Further, the first driving wheel 2 is further provided with a first outer gear 22, a side wall of the main body 1 is further provided with a gear component, and the first outer gear 22 is meshed with the gear component. The robot swimming pool cleaner further includes a rolling brush 4 connected to the gear component.

It may be known from the above description that, responsive to rotating, the first driving wheel 2 drives the rolling brush 4 to rotate, thereby beneficially simplifying a structure of the robot swimming pool cleaner.

Further, a wheel hub of the first inner gear 21, the first outer gear 22 and the first driving wheel 2 are integrally formed by injection molding.

It may be known from the above description that the wheel hub of the first inner gear 21, the first outer gear 22 and the first driving wheel 2 are integrally formed by injection molding, thereby shortening the installation time, improving the production efficiency and beneficially enhancing the overall stability of the wheel.

Further, the gear component includes a first transmission gear 14 and a second transmission gear 15 which are meshed with each other, the first outer gear 22 is meshed with the first transmission gear 14, and the rolling brush 4 is connected to the second transmission gear 15.

It may be known from the above description that the two transmission gears are connected to the rolling brush 4, a position for installation of the rolling brush 4 on the robot swimming pool cleaner may be adjusted, such that the position for installation of the rolling brush 4 is more flexible.

Further, the first outer gear 22, the first transmission gear 14 and the second transmission gear 15 are distributed triangularly, and connecting lines for central rotating axes of the first outer gear, the first transmission gear and the second transmission gear on the same plane form a triangle.

It may be known from the above description that the first outer gear 22, the first transmission gear 14 and the second transmission gear 15 are distributed triangularly, thereby saving a space, such that the first transmission gear 14 and the second transmission gear 15 may be contained inside the first driving wheel 2 to achieve a protection effect on the first transmission gear 14 and the second transmission gear 15.

Further, the side wall of the main body 1 is provided with a third transmission gear 16, a fourth transmission gear 17 and a fifth transmission gear 18; the output shaft of the motor 113 is further provided with a second output gear 13; the inner side of the second driving wheel 3 is provided with a second inner gear 31; the second output gear 13 is meshed with the third transmission gear 16; the third transmission gear 16 is meshed with the fourth transmission gear 17; the fourth transmission gear 17 and the fifth transmission gear 18 are connected to an identical rotating shaft; and the fifth transmission gear 18 is meshed with the second inner gear 31.

It may be known from the above description that by transmission of the second output gear 13, the third transmission gear 16, the fourth transmission gear 17 and the fifth transmission gear 18, the motor 113 simultaneously drives the first driving wheel 2 and the second driving wheel 3 to realize four-wheel drive, thereby improving the obstacle crossing capability of the robot swimming pool cleaner.

Further, the first output gear 12 and the fifth transmission gear 18 are symmetrically disposed relative to a vertical plane where a central axis of the third transmission gear 16 is located.

It may be known from the above description that the first output gear 12 and the fifth transmission gear 18 are symmetrically disposed, thereby decreasing the number of molds and reducing the cost.

Further, the second output gear 13 and the fourth transmission gear 17 are symmetrically disposed relative to the vertical plane where the central axis of the third transmission gear 16 is located.

It may be known from the above description that the first output gear 13 and the fourth transmission gear 17 are symmetrically disposed, thereby decreasing the number of molds and reducing the cost.

Further, a side surface of the main body 1 is provided with a protection plate 19, the protection plate 19 and the main body 1 are connected to form an enclosed space, and the second output gear 13, the third transmission gear 16 and the fourth transmission gear 17 are disposed in the enclosed space.

It may be known from the above description that the enclosed space may protect the gears and prevent particles such as sand and the like, from entering the gears, thereby avoiding gear sticking.

Embodiment I

Referring to FIGS. 1-3, embodiment I of the present application provides a robot swimming pool cleaner, including a main body 1 and a first driving wheel 2 rotatably disposed on the main body 1; the main body 1 is therein provided with a sealed compartment 111 and a garbage bin; the sealed compartment 111 is therein provided with a motor 113; an output shaft of the motor 113 is provided with a first output gear 12; the first output gear 12 is located out of the sealed compartment 111; and inner sides of the first driving wheel 2 are provided with a first inner gear 21 meshed with the first output gear 12.

Specifically, the robot swimming pool cleaner further includes a second driving wheel 3 rotatably disposed on the main body 1, the first driving wheel 2 and the second driving wheel 3 are respectively disposed close to two ends of the main body 1. In the present embodiment, the motor 113 are connected to the first output gear 12; the first output gear 12 are disposed in blank spaces above a left side in the first output gear 12, thus, useless spaces in the first driving wheel 2 are fully utilized; there are two motors 113; the output shafts of the two motors 113 are respectively connected to the first driving wheel 2 on two sides of the robot swimming pool cleaner, the first driving wheel 2 is a rear wheel, and the second driving wheel 3 is a front wheel, or the first driving wheel 2 is the front wheel, and the second driving wheel 3 is the rear wheel; the first driving wheel 2 and the second driving wheel 3 are the same in structure, the first inner gear 21 and second inner gear 31 are the same in structure, and first outer gear 22 and a second outer wheel 32 are the same in structure so as to improve the universality of the wheels, such that the wheels are convenient to replace.

Referring to FIG. 1 and FIG. 3, the first driving wheel 2 is further provided with the first outer gear 22, a side wall of the main body 1 is further provided with a gear component, and the first outer gear 22 is meshed with the gear component. The robot swimming pool cleaner further includes a rolling brush 4 connected to the gear component. The gear component includes a first transmission gear 14 and a second transmission gear 15 which are meshed with each other, the first transmission gear 14 is meshed with the second transmission gear 15, and the rolling brush 4 is connected to the second transmission gear 15. In the present embodiment, the gear component is located in the first driving wheel 2, the rolling brush 4 is located at the bottom of a rear end of the main body 1, and the rolling brush 4 is driven by the first driving wheel 2. In other embodiment, the gear component may be located in the second driving wheel 3, the gear component is meshed with the second outer gear 32, the rolling brush 4 is located at the bottom of a front end of the main body 1, the rolling brush 4 is driven by the second driving wheel 3; the gear component may include one or three transmission gears in an equal quantity, and a rotation speed of the rolling brush 4 may be changed by providing a plurality of transmission gears.

Preferably, wheel hubs of the first inner gear 21, the first outer gear 22 and the first driving wheel 2 are integrally formed by injection molding; the first outer gear 22, the first transmission gear 14 and the second transmission gear 15 are distributed triangularly; and connecting lines for central rotating axes of the first outer gear 22, the first transmission gear 14 and the second transmission gear 15 on the same plane form a triangle. In the present embodiment, an outer side of the main body 1 is provided with a bottom shell 11; the first transmission gear 14 and the second transmission gear 15 are disposed on the bottom shell 11; and the first transmission gear 14 and the second transmission gear 15 are located in spaces below a right side in the first driving wheel 2. In other embodiment, the outer side of the main body 1 may be not provided with the bottom shell 11; the first transmission gear 14 and the second transmission gear 15 may be located outside the first driving wheel 2; or part regions of the first transmission gear 14 and the second transmission gear 15 are located inside the first driving wheel 2, and part regions of the first transmission gear 14 and the second transmission gear 15 are located outside the first driving wheel 2.

Referring to FIG. 1, the side wall of the main body 1 is provided with a third transmission gear 16, a fourth transmission gear 17 and a fifth transmission gear 18; the output shaft of the motor 113 is further provided with a second output gear 13; the inner sides of the second driving wheel 3 is provided with a second inner gear 31; the second output gear 13 is meshed with the third transmission gear 16; the third transmission gear 16 is meshed with the fourth transmission gear 17; the fourth transmission gear 17 and the fifth transmission gear 18 are connected to an identical rotating shaft; and the fifth transmission gear 18 is meshed with the second inner gear 31. In the present embodiment, the third transmission gear 16, the fourth transmission gear 17 and the fifth transmission gear 18 are disposed on the bottom shell 11; while driving the first driving wheel 2 through the third transmission gear 16, the fourth transmission gear 17 and the fifth transmission gear 18, the motor 113 may drive the second driving wheel 3, the fifth transmission gear 18 is located in the space above the right side in the second driving wheel 3.

Referring to FIG. 1, the first output gear 12 and the fifth transmission gear 18 are symmetrically disposed relative to a vertical plane where the central axis of the third transmission gear 16 is located; the second output gear 13 and the fourth transmission gear 17 are symmetrically disposed relative to the vertical plane where the central axis of the third transmission gear 16 is located. In the present embodiment, the first output gear 12 and the fifth transmission gear 18 are the same in structure and size, the second output gear 13 and the fourth transmission gear 17 are the same in structure and size, and the third transmission gear 16 is located in a central region between the first driving wheel 2 and the second driving wheel 3.

Referring to FIG. 1 and FIG. 3, a side surface of the main body 1 is provided with a protection plate 19, the protection plate 19 and the main body 1 are connected to form an enclosed space, and the second output gear 13, the third transmission gear 16 and the fourth transmission gear 17 are disposed in the enclosed space. In the present embodiment, two sides of the main body 1 are provided with the protection plate 19, and the protection plate 19 and the bottom shell 11 disposed on the main body 1 are matched to form the enclosed space configured to protect the gears exposed to the outside.

In conclusion, according to the robot swimming pool cleaner provided by the present application, the first inner gear is provided on the inner side of the first driving wheel, the first output gear is provided on the output shaft of the motor, consequently, the whole sealed compartment provided with the motor may be close to one end of the main body, and a larger space is reserved on the other side of the main body for the garbage bin, thereby improving the loading capacity of the garbage bin; the first outer gear and the gear component which is connected to the rolling brush are provided in the first driving wheel, such that, while driving the first driving wheel, the motor may drive the rolling brush to rotate; in addition, the output shaft of the motor is provided with the second output gear, the side wall of the main body is provided with the transmission gear meshed with the second inner gear disposed on the inner side of the second driving wheel, such that the motor may simultaneously drive the first driving wheel and the second driving wheel of the robot swimming pool cleaner to realize four-wheel drive, thereby improving the obstacle crossing capability of the robot swimming pool cleaner.

The above mentioned content is only the embodiment of the present application and is not intended to limit the patent scope of the present application; equivalent transformations made by use of the specification and drawings of the present application, or direct or indirect applications to related technical fields shall fall within the patent protection scope of the present application.

What is claimed is:

1. A robot swimming pool cleaner, comprising a main body and a first driving wheel rotatably disposed on the main body, wherein the main body is therein provided with a sealed compartment and a garbage bin, the sealed compartment is therein provided with a motor, an output shaft of the motor is provided with a first output gear, the first output gear is located out of the sealed compartment, and an inner side of the first driving wheel is provided with a first inner gear meshed with the first output gear;

wherein the first driving wheel is further provided with a first outer gear, a side wall of the main body is further provided with a gear component, and the first outer gear is in meshed connection with the gear component; the robot swimming pool cleaner further comprises a rolling brush connected to the gear component; wherein the gear component comprises a first transmission gear and a second transmission gear which are meshed with each other, the first outer gear is meshed with the first transmission gear, and the rolling brush is connected to the second transmission gear.

2. The robot swimming pool cleaner according to claim 1, further comprising a second driving wheel rotatably disposed on the main body, wherein the first driving wheel is disposed close to a front end of the main body, and the second driving wheel is disposed close to a rear end of the main body.

3. The robot swimming pool cleaner according to claim 1, wherein wheel hubs of the first inner gear, the first outer gear and the first driving wheel are integrally formed by injection molding.

4. The robot swimming pool cleaner according to claim 1, wherein connecting lines for central rotating axes of the first outer gear, the first transmission gear and the second transmission gear on the same plane form a triangle.

5. The robot swimming pool cleaner according to claim 1, wherein the side wall of the main body is provided with a third transmission gear, a fourth transmission gear and a fifth transmission gear; the output shaft of the motor is further provided with a second output gear; an inner side of the second driving wheel is provided with a second inner gear; the second output gear is meshed with the third transmission gear; the third transmission gear is meshed with the fourth transmission gear; the fourth transmission gear and the fifth transmission gear are connected to an identical rotating shaft; and the fifth transmission gear is meshed with the second inner gear.

6. The robot swimming pool cleaner according to claim 5, wherein the first output gear and the fifth transmission gear are symmetrically disposed relative to a vertical plane where a central axis of the third transmission gear is located.

7. The robot swimming pool cleaner according to claim 5, wherein the second output gear and the fourth transmission gear are symmetrically disposed relative to the vertical plane where the central axis of the third transmission gear is located.

8. The robot swimming pool cleaner according to claim 5, wherein a side surface of the main body is provided with a protection plate, the protection plate and the main body are connected to form an enclosed space, and the second output gear, the third transmission gear and the fourth transmission gear are disposed in the enclosed space.

9. The robot swimming pool cleaner according to claim 2, wherein the side wall of the main body is provided with a third transmission gear, a fourth transmission gear and a fifth transmission gear; the output shaft of the motor is further provided with a second output gear; an inner side of the second driving wheel is provided with a second inner gear; the second output gear is meshed with the third transmission gear; the third transmission gear is meshed with the fourth transmission gear; the fourth transmission gear and the fifth transmission gear are connected to an identical rotating shaft; and the fifth transmission gear is meshed with the second inner gear.

10. The robot swimming pool cleaner according to claim 9, wherein the first output gear and the fifth transmission gear are symmetrically disposed relative to a vertical plane where a central axis of the third transmission gear is located.

11. The robot swimming pool cleaner according to claim 9, wherein the second output gear and the fourth transmission gear are symmetrically disposed relative to the vertical plane where the central axis of the third transmission gear is located.

12. The robot swimming pool cleaner according to claim 9, wherein a side surface of the main body is provided with a protection plate, the protection plate and the main body are connected to form an enclosed space, and the second output gear, the third transmission gear and the fourth transmission gear are disposed in the enclosed space.

* * * * *